US005900772A

United States Patent [19]

Somerville et al.

[11] Patent Number: 5,900,772

[45] Date of Patent: May 4, 1999

[54] BANDGAP REFERENCE CIRCUIT AND METHOD

[75] Inventors: Thomas A. Somerville; Robert L. Vyne, both of Tempe, Ariz.

[73] Assignee: Motorola, Inc., Schaumburg, Ill.

[21] Appl. No.: 08/819,899

[22] Filed: Mar. 18, 1997

[51] Int. Cl.[6] ..... G05F 1/10

[52] U.S. Cl. ..... 327/539; 327/538

[58] Field of Search ..... 327/538, 539, 327/540; 323/313, 315

[56] References Cited

U.S. PATENT DOCUMENTS

| | | | |
|---|---|---|---|
| 4,636,710 | 1/1987 | Stanojevic | 323/280 |
| 5,173,656 | 12/1992 | Seevinck | 323/314 |
| 5,313,165 | 5/1994 | Brokaw | 324/414 |
| 5,339,020 | 8/1994 | Siligoni et al. | 323/313 |
| 5,448,174 | 9/1995 | Gose et al. | 327/513 |
| 5,550,464 | 8/1996 | Lorenz | 323/315 |
| 5,592,121 | 1/1997 | Jung et al. | 327/541 |
| 5,635,869 | 6/1997 | Ferraiolo et al. | 327/543 |
| 5,675,243 | 10/1997 | Kamata | 323/313 |

*Primary Examiner*—Timothy P. Callahan
*Assistant Examiner*—Maria Hasanzadah
*Attorney, Agent, or Firm*—Rennie William Dover; Lanny L. Parker

[57] ABSTRACT

A bandgap reference circuit (60) provides a selectable bandgap reference voltage that is substantially insensitive to temperature variations of an operating reference circuit. A final curvature caused by a current ($I_2$) in a temperature coefficient compensation transistor (40) is equal to a drift in a Vbe voltage of a transistor (18) having a negative temperature coefficient plus the drift in a Vbe voltage of a transistor (20) having a positive temperature coefficient minus the drift in a Vbe voltage of the temperature coefficient compensation transistor (40). The nonlinearity of the current ($I_2$) in the temperature coefficient compensation transistor (40) is adjusted by selecting a compensating current and associated temperature coefficient for the compensating current ($I_0$) to minimize the characteristic bow or curvature of the current ($I_2$) in the temperature coefficient compensation transistor (40).

13 Claims, 2 Drawing Sheets

10

BANDGAP REFERENCE CIRCUIT AND METHOD

BACKGROUND OF THE INVENTION

The present invention relates, in general, to integrated circuits and, more particularly, to an integrated circuit for generating a bandgap reference voltage.

Electronic circuits such as, cellular telephones, laptop computers, coders/decoders, and voltage regulators require a stable and accurate reference voltage for effective operation. However, reference voltages may not remain constant due to temperature variations that occur during circuit operation. A circuit known as a bandgap reference voltage generator is used to compensate for the temperature dependence of reference voltages and provide a constant reference voltage.

Typically, a bandgap reference voltage generator must provide a reference voltage that has less than a one percent change in voltage over the operating temperature range. One indication of the performance of the reference voltage generator is the shape of the plot of the reference voltage versus temperature. The plot is characterized by the reference voltage increasing as the temperature is increased until an inflection temperature is reached, at which point the reference voltage decreases. The curvature of this plot is referred to as the characteristic bow of the temperature response.

A common technique for generating a bandgap reference voltage is to use thin film resistors to generate the reference voltage. Although thin film resistors have a temperature coefficient of about zero, they require additional processing steps that increases the cost of the integrated circuit.

Accordingly, it would be advantageous to have an improved method and circuit for providing a stable and accurate reference voltage. It would be of further advantage to compensate for second order effects on the temperature coefficient of a transistor's base-emitter voltage. In addition, it would be desirable to provide a low cost bandgap reference voltage generator that is independent of changes in operating and process characteristics.

DETAILED DESCRIPTION OF THE DRAWINGS

Generally, the present invention provides a selectable bandgap reference voltage that is substantially insensitive to temperature variations of the operating reference circuit. In accordance with one embodiment of the present invention, a current having a positive temperature coefficient is added to a current having a negative temperature coefficient to produce a current having a substantially zero temperature coefficient. More particularly, the current having the negative temperature coefficient also has second order nonlinearities that are selected to compensate for the nonlinearities in the current generating the bandgap reference voltage.

Figure 1:
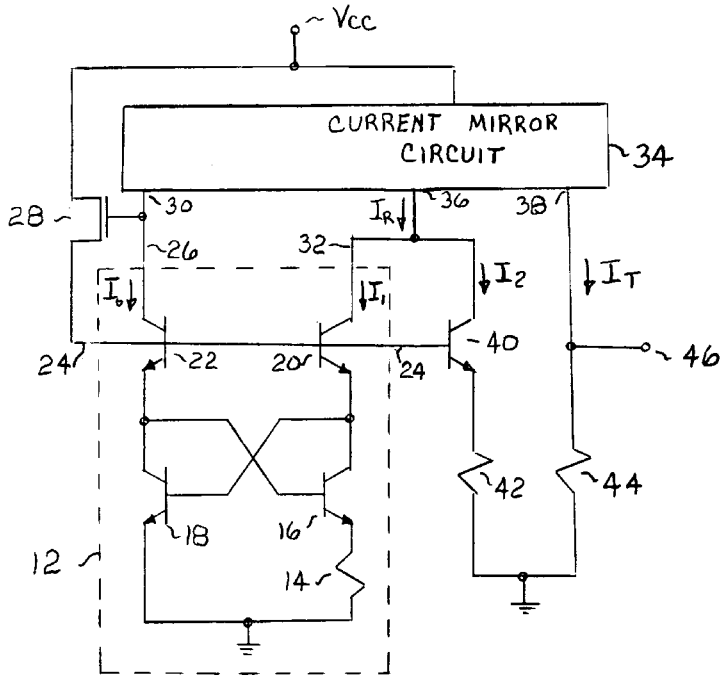
FIG. 1 is a schematic diagram of a reference voltage circuit in accordance with the present invention.

FIG. 1 is a schematic diagram of a bandgap reference voltage circuit 10 in accordance with the present invention. Reference voltage circuit 10 is comprised of a proportional to absolute temperature (PTAT) current source 12, a metal oxide semiconductor field effect transistor (MOSFET) 28, a current mirror circuit 34, a transistor 40, and resistors 42 and 44. In particular, PTAT current source 12 includes a resistor 14 having one terminal commonly connected to the emitter terminal of a transistor 18 and to a power supply terminal that is coupled for receiving an operating potential such as, for example, ground. The other terminal of resistor 14 is connected to the emitter terminal of a transistor 16. The base terminal of transistor 16 is commonly connected to the collector terminal of transistor 18 and to an emitter terminal of a transistor 22. The base terminal of transistor 18 is commonly connected to the collector terminal of transistor 16 and to an emitter terminal of a transistor 20. The base terminals of transistors 20 and 22 are commonly connected and serve as an input 24 of PTAT current source 12. The collector terminals of transistors 20 and 22 serve as output 32 and input 26, respectively, of PTAT current source 12. As those skilled in the art are aware, the base terminal of a transistor is also referred to as a control electrode and the collector and emitter terminals are also referred to as current carrying electrodes. Bandgap reference voltage circuit 10 may be manufactured using a bipolar process, a complementary metal oxide semiconductor (CMOS) process, or a combination bipolar and complementary metal oxide semiconductor (BICMOS) process.

The gate terminal of MOSFET 28 is commonly connected to output 30 of current mirror circuit 34 and to input 26 of PTAT current source 12. The source terminal of MOSFET 28 is connected to input 24 of PTAT current source 12. The drain terminal of MOSFET 28 is connected to a power supply terminal that is coupled for receiving an operating potential such as, for example, Vcc. As those skilled in the art are aware, the gate terminal of a MOSFET is also referred to as a control electrode and the source and drain terminals are also referred to as current carrying electrodes.

In addition, the base terminal and collector terminal of transistor 40 are connected to input 24 and output 32, respectively, of PTAT current source 12. The emitter terminal of transistor 40 is connected to one terminal of resistor 42. The other terminal of resistor 42 is commonly connected to one terminal of resistor 44 and to a power supply terminal that is coupled for receiving an operating potential such as, for example, ground. The other terminal of resistor 44 serves as output terminal 46 of reference voltage circuit 10. Current mirror circuit 34 has a terminal connected to a power supply terminal that receives the operating potential Vcc, an input 36 that is commonly connected to the collector terminals of transistors 20 and 40, and an output 38 that is connected to terminal 46 of reference voltage circuit 10. to the negative of the temperature coefficient of resistor 44. The curvature of plot 18A is greater than the curvature of plot 20A. It should be noted that the current flowing through transistor 18 also has a zero temperature coefficient when resistors having a zero temperature coefficient are used in the circuit. Plot 40A illustrates the Vbe voltage drift nonlinearity over temperature of transistor 40. The current flowing through transistor 40 has a negative temperature coefficient and the curvature of plot 40A is greater than that of either plot 20A or 18A.

A horizontal line 51, which is drawn at the point where plots 20A, 18A, and 40A peak, is a zero reference line. The magnitude of the voltage drift nonlinearity at a given temperature is measured as the difference between a Vbe voltage drift nonlinearity value on the particular plot and the value at the same temperature on horizontal line 51. By way of example, the magnitude of the voltage drift nonlinearity of transistor 20 at a temperature of 125° C. is the voltage difference between the value of plot 20A at a temperature of +125° C. and horizontal line 51.

In operation, bandgap reference voltage circuit 10 provides curvature correction that minimizes the nonlinearities in the reference voltage over temperature. Referring again to FIG. 1, PTAT circuit 12 generates an output current $I_1$ having a positive temperature coefficient. Current $I_1$ is added to a current $I_2$ having a negative temperature coefficient to produce a current $I_R$, which is transmitted to input 36 of current mirror circuit 34. Current $I_R$ is mirrored to outputs 30 and 38 of current mirror circuit 34.

Preferably, the temperature coefficients of currents $I_1$ and $I_2$ cancel each other so that the current $I_T$ that is mirrored from current $I_R$ generates a substantially It should be noted that resistors 14, 42, and 44 are implanted resistors but could also be diffused resistors, discrete resistors, thin film resistors, metal film resistors, etc. The type of resistor is not a limitation of the present invention. However, resistors 14, 42, and 44 are preferably the same type of resistor. It should be noted that resistor 44 could be comprised of multiple resistors serially connected to provide tap points for selecting a portion of the voltage that is developed as the output voltage at terminal 46.

Figure 2:
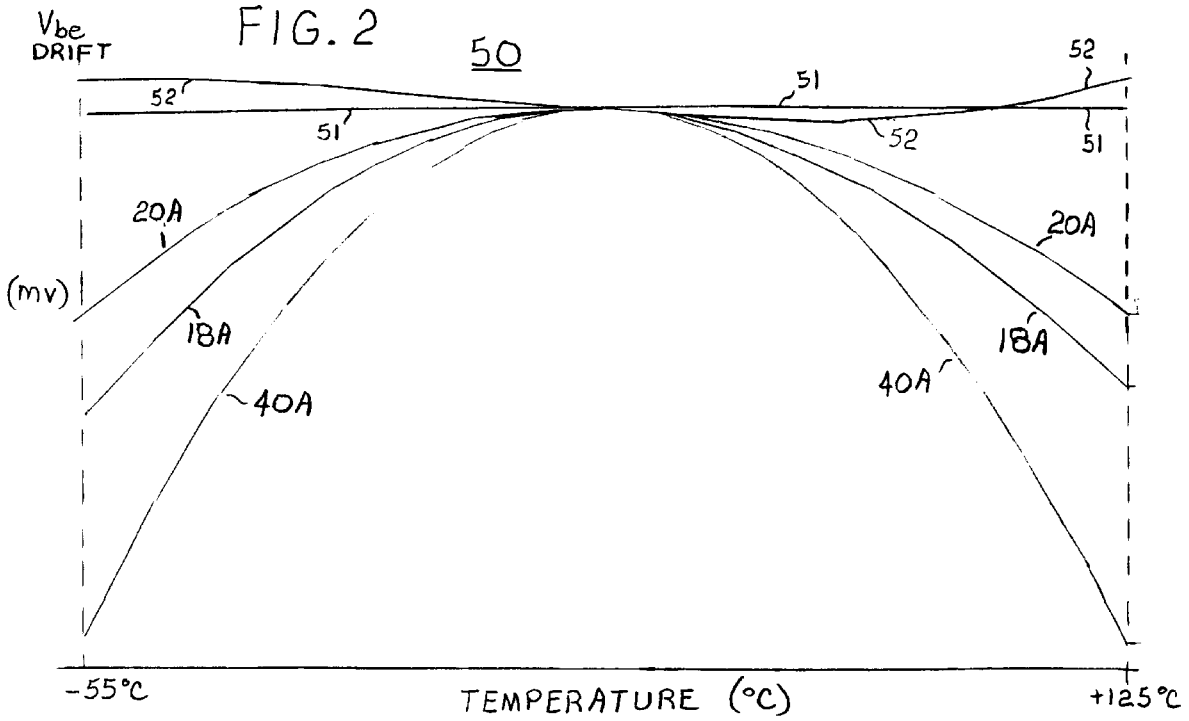
FIG. 2 is a series of plots that illustrate the nonlinearity of the base-emitter voltage temperature drift for several transistors.

FIG. 2 is a series of plots 50 illustrating the nonlinearity of the base-emitter voltage temperature drift for several transistors. The horizontal axis represents temperature in degrees centigrade (° C.) and the vertical axis represents the nonlinearity in the voltage drift of the base-emitter junction voltage (Vbe) in millivolts (mv). Plots 20A, 18A, and 40A are shown over the temperature range of −55° C. to +125° C. The plots have a characteristic bow or curvature in which the voltage drift initially increases as the temperature increases above the temperature of −55° C. After the voltage drift peaks at a temperature of, for example, about 25° C., the voltage drift decreases in value. The amount of curvature depends on the temperature coefficient of the current flowing through the base-emitter junctions of transistors 40, 18, and 20.

Plot 20A illustrates the Vbe voltage drift nonlinearity over temperature of transistor 20. The collector current $I_1$ flowing through transistor 20 is proportional to absolute temperature (PTAT current) and has a positive temperature coefficient. Plot 18A illustrates the Vbe voltage drift nonlinearity over temperature of transistor 18. The current flowing through transistor 18 has a temperature coefficient equal zero temperature coefficient voltage at output 46. The current generated at output 30 by current mirror 34 is input into PTAT circuit 12 and is identified as current $I_0$. Current $I_0$ is proportional to current $I_R$, wherein the proportionality constant is set in accordance with the emitter areas of transistors 16, 18, 20, and 22. For example, the value of current $I_0$ can be set to be half the value of current $I_R$ by selecting the emitter areas of transistors 18 and 22 to be the same and twice that of transistor 20.

The current $I_1$ is given by:

$$I_1=(V_T*ln(n))/R_{14}$$

where:

$V_T$ is the thermal voltage kT/q;

k is Boltzmann's constant;

q is the electronic charge;

T is the absolute temperature (degrees Kelvin);

n is the ratio of the emitter area of transistor 16 to the emitter area of transistor 20; and $R_{14}$ is the resistance value of resistor 14.

The current I2 is given by:

$$I_2=(V_{be18}+V_{be20}-V_{be40})/R_{42}$$

where:

$V_{be18}$ is the base-emitter voltage of transistor 18;

$V_{be20}$ is the base-emitter voltage of transistor 20;

$V_{be40}$ is the base-emitter voltage of transistor 40; and $R_{42}$ is the resistance value of resistor 42.

The Vbe of a bipolar transistor depends on the wafer fabrication process used to manufacture the transistor and on the temperature coefficient of the current flowing in the transistor. The present invention reduces the nonlinearity of the temperature variation of the current $I_2$ by setting a voltage across resistor 42 in which the temperature generated Vbe changes of transistors 18, 20, and 40 have been compensated. The voltage across resistor 42 is set to equal the sum of the Vbe voltages of transistors 18 and 20 minus the Vbe voltage of transistor 40. Thus, the curvature of the current $I_2$ is equal to the curvature of the voltage drift nonlinearity in the Vbe of transistor 18 plus the curvature of the voltage drift nonlinearity in the Vbe of transistor 20 minus the curvature of the voltage drift nonlinearity in the Vbe of transistor 40. For example, the magnitude of the Vbe voltage drift value of transistors 18, 20, and 40 at a selected temperature is represented as the difference between horizontal line 51 and a value on line 52 that is the sum of: (1) the difference between horizontal line 51 and the Vbe voltage drift value of transistor 18, (2) the difference between horizontal line 51 and the Vbe voltage drift of transistor 18, and (3) the difference between horizontal line 51 and the Vbe voltage drift value of transistor 40 at the selected temperature.

It should be noted that current $I_1$ is unaffected by the magnitude of current $I_0$ as long as transistors 18 and 22 have equal emitter areas. However, the magnitude of current $I_0$ includes both linear and nonlinear temperature variations that do affect current $I_2$. In particular, the nonlinear components of current $I_0$ change the base-emitter voltages of transistors 18, 20, and 40 as they drift over a range of temperatures. Briefly referring to FIG. 2, the nonlinearity of the base-emitter voltage drift of transistors 18, 20, and 40 are shown. The base-emitter voltages of transistors 18, 20, and 40 drift with a bow-shaped nonlinearity characteristic similar to those shown in FIG. 2. The amount of nonlinear drift depends on the temperature characteristic of the current flowing through each transistor. The curvature of current $I_2$ depends on the sum of the curvature of transistors 18 and 20 minus the curvature of transistor 40. It should be noted that the curvature of current $I_2$ is proportional to the sum of $V_{be18}$ and $V_{be20}$ minus $V_{be40}$. Thus, the curvature of the Vbe voltage of transistor 40 can be compensated by a proper selection of current $I_0$. Current $I_0$ is selected such that the sum of the base-emitter voltages of transistors 18 and 20 minus the base-emitter voltage of transistor 40 at a particular temperature is substantially constant.

The current generated at output 38 by current mirror 34 is input into resistor 44 to generate a bandgap reference voltage having a substantially zero temperature coefficient at output 46.

Figure 3:
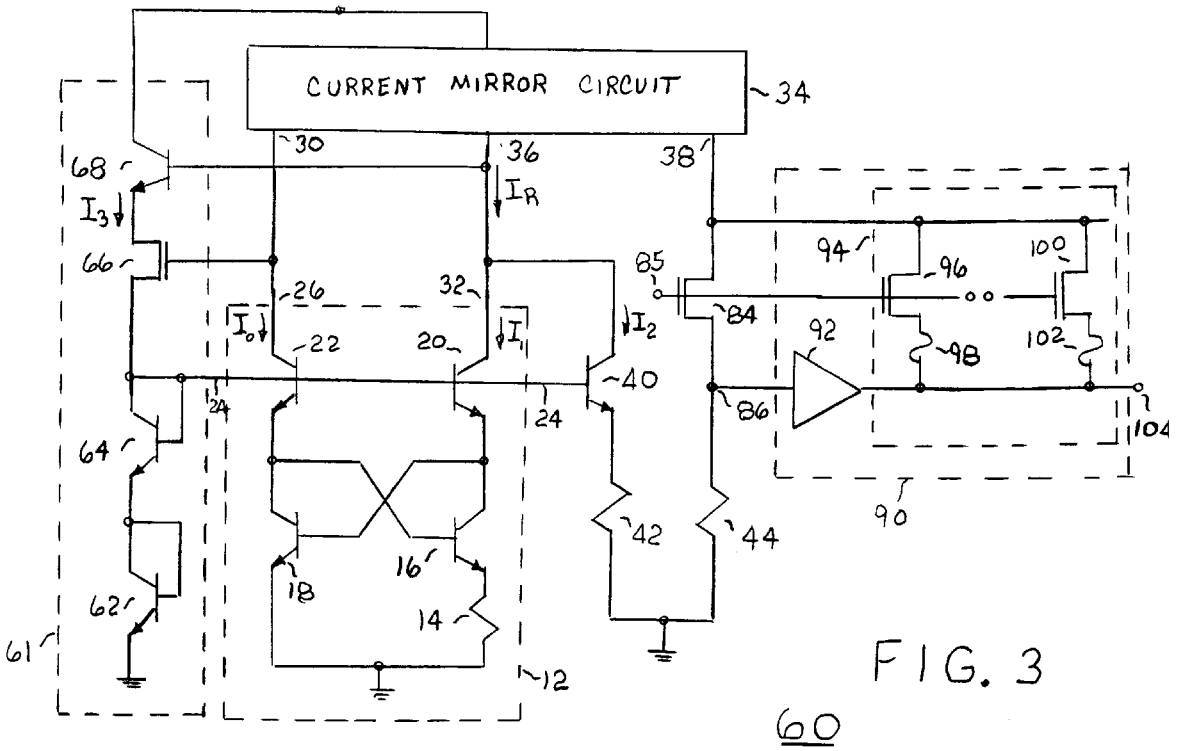
FIG. 3 is a schematic diagram of a trimmed bandgap reference circuit in accordance with the present invention.

FIG. 3 is a schematic diagram of a trimmed bandgap reference circuit 60 in accordance with the present invention. It should be noted that the same reference numbers are used in the figures to denote the same elements. Trimmed bandgap reference circuit 60 is comprised of PTAT current source 12, a beta compensation circuit 61, a transistor 40, a MOSFET 84, resistors 42 and 44, a current mirror circuit 34, and a reference voltage trim circuit 90. It should be further noted that beta is current gain for a transistor and defined as the ratio of collector current to base current, i.e., beta $(\beta)=I_C/I_B$. Beta compensation circuit 61 includes NPN transistors 62, 64, and 68, and a MOSFET 66. In particular, the emitter terminal of transistor 62 is connected to a supply terminal that is coupled for receiving a supply potential such as, for example, ground. Transistors 62 and 64 are diode connected. In other words, the base and collector terminals of transistor 62 are commonly connected to each other and to the emitter terminal of transistor 64. The base and collector terminals of transistor 64 are commonly connected to each other and to the source terminal of MOSFET 66 and to input 24 of PTAT current source 12. Thus, input 24 is coupled to ground reference through two diodes, i.e., the base-emitter junctions of transistors 62 and 64. The gate terminal of MOSFET 66 is connected to input 26 of PTAT current source 12. The drain terminal of MOSFET 66 is connected to the emitter terminal of transistor 68. The base terminal of transistor 68 is commonly connected to output 32 of PTAT current source 12 and to input 36 of current mirror circuit 34. The collector terminal of transistor 68 is connected to a power supply terminal that is coupled for receiving an operating potential such as, for example, Vcc.

Current mirror circuit 34 has an output 38 that is connected to the source terminal of MOSFET 84. A gate terminal of MOSFET 84 serves as terminal 85 and a drain terminal of MOSFET 84 is connected to one terminal of resistor 44. The other terminal of resistor 44 is connected to a power supply terminal which is coupled for receiving, for example, a ground potential. The signal at terminal 85 is provided from current mirror circuit 34 and is a voltage bias for the gate terminals of MOSFETs 84, 96, and 100.

Voltage reference trim circuit 90 is comprised of a buffer circuit 92 and current steering circuit 94. Buffer circuit 92 has an input that serves as an input of current steering circuit 94 and is connected to node 86. The output of buffer circuit 92 serves as the output of current steering circuit 94 and is connected to terminal 104 as the output of trimmed bandgap reference circuit 60. One terminal of fusible link 98 and one terminal of fusible link 102 are connected to the output of buffer circuit 92. The other terminal of fusible link 98 is connected to the drain terminal of MOSFET 96 and the other terminal of fusible link 102 is connected to the drain terminal of MOSFET 100. The source terminals of MOSFETs 96 and 100 are commonly connected to each other and to the source terminal of MOSFET 84. It should be noted that additional MOSFET and fusible link combinations can be connected in parallel with MOSFETs 96 and 100 and fusible links 98 and 102. The number of MOSFET and fusible link combinations in current steering circuit 94 is not a limitation of the present invention.

Figure 4:
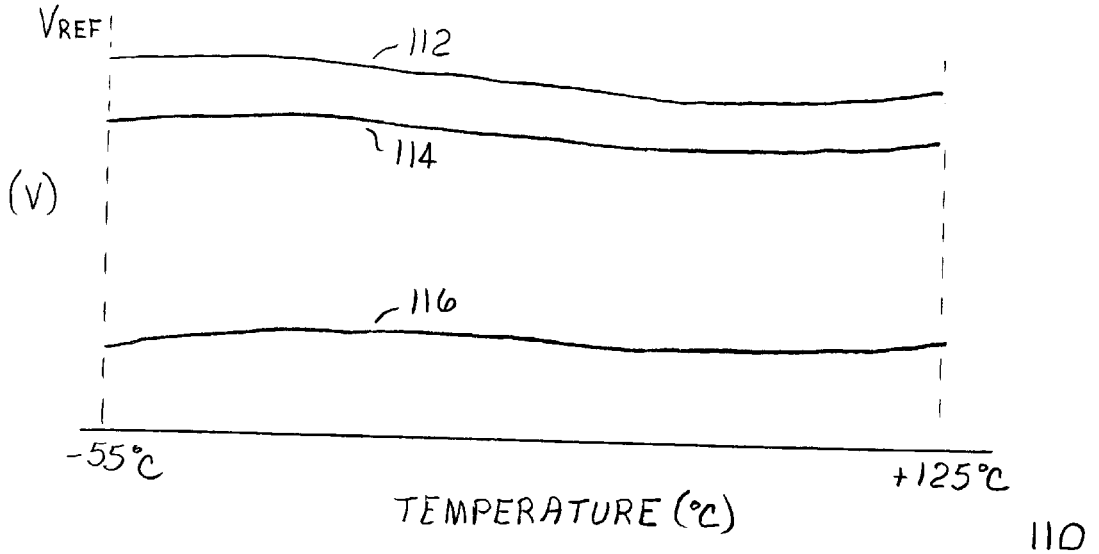
FIG. 4 is a plot that illustrates the curvaturecorrected bandgap reference voltage in accordance with the present invention.

FIG. 4 is a plot 110 that illustrates the curvature-corrected bandgap reference voltage. The horizontal axis represents the temperature in degrees centigrade (° C.) and the vertical axis represents the reference voltage at nodes 86 and 104 (see FIG. 3) measured in volts (V). Plots 112, 114, and 116 show the reference voltage changes over temperature when all of the transistors 16–22, 62, 64, 68, and 40 in trimmed bandgap reference circuit 60 have beta (β) values of one of about 400, 250, or 100.

In operation, transistor 68 injects base current into transistors 20 and 40 to compensate for transistor beta changes. When, through processing, the betas are reduced for transistors such as, for example, transistors 20 and 40, the transistors need more base current to provide the transistors with collector current. The base current in transistor 68 is added to the collector currents of transistors 20 and 40, which are then fed into current mirror circuit 34. However, it should be noted that when the base current of transistor 68 matches the base currents of transistors 20 and 40, complete base current cancellation occurs and the curvature is not minimized. It is preferred that the base current of transistor 68 be less than the base currents of transistors 20 and 40.

The current $I_0$ in transistor 22 is selected to minimize the curvature or the nonlinearity in the reference voltage at node 86. By way of example, the current $I_0$ can be selected to have a value that is about $(I_1+I_2)/2$. On the other hand, current $I_3$ of transistor 68 is selected to adjust for transistor beta variation by providing a base current sufficient to compensate for the base currents of transistors 20 and 40. These currents vary nonlinearly with temperature. By way of example, the current $I_3$ is selected to have a value that is about equal to the square root of one half times a product of current $I_0$ and current $I_1$, i.e., $\sqrt{(I_0*I_1)}/2$.

Transistors 68 and 84 and reference voltage trim circuit 90 provide correction that negates the process differences that change the transistor beta. FIG. 4 illustrates that trimmed bandgap reference circuit 60 provides a reference voltage at node 86 that has substantially the same shape over temperature for different transistor betas. Trim circuit 90 provides an offset correction current that modifies the magnitude of the current flowing through resistor 44 in adjusting the amplitude of the reference voltage. The multiple MOSFETs such as, for example, MOSFETs 96 and 100, are binary-weighted in accordance with geometric gate widths and lengths. Fusible links 98 and 102 allow current that normally flows through MOSFETs 96 and 100, respectively, to a ground potential in buffer circuit 92 to be redirected and flow through trim transistor MOSFET 84 and resistor 44. For example, fusible links 98 and 102 can be opened with a current pulse at probe and cause the current normally flowing through those fusible links to be redirected into MOSFET 84 and resistor 44 to raise the reference voltage at node 86. Buffer circuit 92 provides a high impedance input and provides a buffered output for the reference voltage value at terminal 104. In addition, buffer circuit 92 allows MOSFETs such as, for example, MOSFETs 96 and 100 to have a common drain voltage that provides accurate current scaling when the MOSFET gate areas are binary weighted. By selectively opening links such as fusible links 98 and 102, trimmed bandgap reference circuit 60 can raise the output reference voltage at terminal 104 and provide correction for the variations in the beta value of the transistors of trimmed bandgap reference circuit 60.

By now it should be appreciated that the circuit and method of the present invention provide a stable and accurate reference voltage. The trimmed bandgap reference circuit substantially eliminates the second order effects on the temperature coefficient of a transistor's base-emitter voltage. The trimmed bandgap reference circuit further provides a low cost bandgap reference voltage that is independent of changes in operating and process characteristics.

We claim:

1. A bandgap reference circuit comprising:

a proportional to absolute temperature (PTAT) current source having a first input, a second input, and an output;

a first resistor;

a first transistor having a control electrode coupled to the second input of the PTAT current source, a first current carrying electrode coupled to the first input of the PTAT current source, and a second current carrying electrode coupled to a first power supply conductor;

a current mirror circuit having a first terminal coupled to the control electrode of the first transistor, and a second terminal coupled to the output of the PTAT current source; and a second transistor having a control electrode coupled to the first input of the PTAT current source, a first current carrying electrode coupled through the first resistor to a second power supply conductor, and a second current carrying electrode coupled to the output of the PTAT current source.

2. The bandgap reference circuit of claim 1, further comprising a third transistor having a control electrode coupled to the second terminal of the current mirror circuit, a first current carrying electrode coupled to the second current carrying electrode of the first transistor, and a second current carrying electrode coupled to the first power supply conductor.

3. The bandgap reference circuit of claim 2, further comprising a second resistor having a first terminal coupled to a third terminal of the current mirror circuit and a second terminal coupled to the second power supply conductor for providing a reference voltage output.

4. The bandgap reference circuit of claim 1, wherein the PTAT current source further comprises:

a first current source transistor having a control electrode, a first current carrying electrode, and a second current carrying electrode;

a second current source transistor having a control electrode, a first current carrying electrode, and a second current carrying electrode, wherein the second current carrying electrode of the second current source transistor serves as the second input of the PTAT current source and the first current carrying electrode of the second current source transistor is coupled to the second current carrying electrode of the first current source transistor;

a third current source transistor having a control electrode, a first current carrying electrode, and a second current carrying electrode, wherein the control electrode of the third current source transistor is coupled to the control electrode of the second current source transistor and serves as the first input of the PTAT current source, the second current carrying electrode of the third current source transistor serves as the output of the PTAT current source, and the first current carrying electrode of the third current source transistor is coupled to the control electrode of the first current source transistor;

a fourth current source transistor having a control electrode, a first current carrying electrode, and a second current carrying electrode, wherein the control electrode of the fourth current source transistor is coupled to the first current carrying electrode of the second current source transistor, and the second current carrying electrode of the fourth current source transistor is coupled to the first current carrying electrode of the third current source transistor; and a third resistor having a first terminal coupled to the first current carrying electrode of the fourth current source transistor and a second terminal coupled to the first current carrying electrode of the first current source transistor.

5. The bandgap reference circuit of claim 4, further comprising:

a first diode connected transistor having a control electrode coupled to a second current carrying electrode and to the first input of the PTAT current source; and a second diode connected transistor having a control electrode coupled to the second current carrying electrode and to the first current carrying electrode of the first diode connected transistor, and a first current carrying electrode coupled to the second power supply conductor.

6. The bandgap reference circuit of claim 3, further comprising:

a trim transistor having a control electrode coupled for receiving a bias signal, a second current carrying electrode coupled to the third terminal of the current mirror circuit, and a first current carrying electrode coupled to a first terminal of the second resistor; and a reference voltage trim circuit having a first input, a second input, and an output, wherein the first input is coupled to the second current carrying electrode of the trim transistor and the second input is coupled to the first current carrying electrode of the trim transistor.

7. The bandgap reference circuit of claim 6, wherein the reference voltage trim circuit further comprises:

a buffer circuit having an input and an output;

a current steering transistor having a control electrode coupled to the control electrode of the trim transistor, a first current carrying electrode coupled to the first input of the reference voltage trim circuit; and a fusible link having a first terminal coupled to the second current carrying electrode of the current steering transistor and a second terminal coupled to the output of the buffer circuit.

8. A method for generating a bandgap reference voltage, comprising the steps of:

operating a first transistor at a first current, the first current having a first positive temperature coefficient and generating a first voltage across a junction of the first transistor;

operating a second transistor at a second current, the second current having a a second positive temperature coefficient and generating a second voltage across a junction of the second transistor;

operating a third transistor at a third current, the third current having a negative temperature coefficient that is equal to a sum of the first and second positive temperature coefficients and Generating a third voltage across a junction of the third transistor; and generating a voltage that is the third voltage subtracted from a sum of the first and second voltages, wherein the voltage is substantially constant over temperature.

9. The method of claim 8, further comprising the step of providing a sum of the second and third currents to generate a mirrored current that generates the bandgap reference voltage.

10. The method of claim 8, further including setting the first current to a value of about one half a sum of the second and third currents.

11. The method of claim 9, further comprising the step of adjusting for variations in current gain of the first transistor, the second transistor, and the third transistor by adjusting the mirrored current.

12. A bandgap reference circuit comprising:

a resistor;

a current mirror circuit having an input and an output;

a proportional to absolute temperature (PTAT) current source having a first input that receives a bias voltage, a second input that receives a first current from the output of the current mirror, and an output that supplies a second current to the input of the current mirror; and a first transistor having a base terminal coupled to the first input of the PTAT current source, a collector terminal coupled to the output of the PTAT current source, and an emitter terminal coupled through the resistor to a power supply conductor, wherein nonlinear temperature variations of the first and second currents substantially cancel nonlinear temperature variations of a current conducted through the first transistor such that a voltage at the emitter terminal of the first transistor is substantially constant.

13. The bandgap reference circuit of claim 12, further including a beta compensation circuit, comprising:

a second transistor having a base terminal coupled to a collector terminal, and an emitter terminal coupled to a first power supply conductor;

a third transistor having a base terminal coupled to a collector terminal and to the first input of the PTAT current source, and an emitter terminal coupled to the base terminal of the second transistor; and a fourth transistor having a base terminal coupled to the output of the PTAT current source, an emitter coupled to the first input of the PTAT current source, and a collector terminal coupled to a second power supply conductor.

* * * * *